US006627012B1

(12) United States Patent
Tack et al.

(10) Patent No.: US 6,627,012 B1
(45) Date of Patent: Sep. 30, 2003

(54) METHOD FOR PRODUCING LIGHTWEIGHT ALLOY STOCK FOR GUN FRAMES

(75) Inventors: Wm. Troy Tack, Glenelg, MD (US); Lawrence S. Kramer, 5401 Twin Knolls Rd, Suite 11, Columbia, MD (US) 21045

(73) Assignees: William Troy Tack, Glenely, MD (US); Lawrence S. Kramer, Dayton, MD (US)

( * ) Notice: Subject to any disclaimer, the term of this patent is extended or adjusted under 35 U.S.C. 154(b) by 15 days.

(21) Appl. No.: 09/681,076

(22) Filed: Dec. 22, 2000

(51) Int. Cl.[7] ..... C22F 1/04
(52) U.S. Cl. ..... 148/690; 29/592
(58) Field of Search ..... 148/690; 29/592

(56) References Cited

U.S. PATENT DOCUMENTS 5,221,377 A * 6/1993 Hunt et al. ..... 148/417
5,865,911 A * 2/1999 Miyasato et al. ..... 148/438
6,027,582 A * 2/2000 Shahani et al. ..... 148/417

OTHER PUBLICATIONS

Bushmaster Firearms 2002 Catalog, http://www.bushmaster.com.*

* cited by examiner

*Primary Examiner*—Roy King
*Assistant Examiner*—Andrew Wessman

(57) ABSTRACT

The present invention relates to a method for fabricating lightweight alloy feedstock for gun frames. Specifically, the method for producing the work stock proposed in the present invention enables a gun manufacturer to readily machine or forge a suitable gun frame. The properties attained in the final product allow the gun manufacturer to reduce the overall weight of the gun without sacrificing durability.

13 Claims, No Drawings

METHOD FOR PRODUCING LIGHTWEIGHT ALLOY STOCK FOR GUN FRAMES

BACKGROUND OF INVENTION

The primary objective of this invention is to provide a method for producing a suitable lightweight starting stock that can be used by gun manufacturers for gun components. Another objective is to provide a method for producing a lightweight aluminum starting stock that can be readily forged into components such as gun frames. It is yet another objective to provide a method for producing a lightweight aluminum alloy starting stock that can be machined into a variety of gun components. Another objective is to provide a suitable method for producing a lightweight starting stock that provides enhanced mechanical properties for gun components. A final objective is to provide a method for producing a lightweight aluminum alloy starting stock that, once fabricated into a suitable gun frame, can withstand repeated firing loads.

SUMMARY OF INVENTION

This invention provides a method to produce an aluminum starting stock alloy that can readily be manufactured into gun frames and gun components with said frames and components providing substantially reduced weight relative to steel frames and components while simultaneously providing outstanding durability. Another objective of this invention is as a replacement for firearm frames and components comprised of 7075 or cast aluminum alloys. In this instance, the superior mechanical properties and superior performance under repeated shock loading indicate that the components produced using the methods taught in this invention can be substantially reduced in cross-sectional thickness and substituted for alloy 7075 and cast aluminum alloy frames and components. In this instance, the weight of the final handgun is reduced by the use of smaller frames and components.

While the scope of this invention is oriented toward handgun frames, many other components that are traditionally comprised of steel can now be fabricated using the principles of this invention, including cylinders, scopes, mounts, rings, fasteners, triggers and other gun components. Moreover, the invention anticipates use in rifle and shotgun components as well. This extension of the principle also applies to military firearms such as automatic and semi-automatic machine guns, and recreational firearms such as pellet and paintball guns.

The starting stock of this invention clearly demonstrates superior mechanical properties and can be readily forged into a gun frame. A more surprising result is that a heavy-caliber revolver frame fabricated from the starting stock alloy of this invention can withstand repeated firing loads, a result previously attained only with high strength steel and titanium alloys. Since the starting stock enables the gun frame weight to be one-third that of steel, substantial weight savings are realized to the entire gun. As reported in Combat Handguns (November 2000, pp. 28–33, 96–97), several advantages of various revolver models were detailed:

Using the processing method proposed in this invention, a .357 Magnum revolver was provided wherein the lightweight was advantageous for backpacking requirements. Previously, backpackers experienced a substantial weight addition when a heavy caliber revolver was included in their gear.

The processing method of this invention was used in the production of six different revolver models that had extremely good accuracy in target tests, with a consistent six-inch grouping from a shooting distance of 50 feet. This is a surprising result since most shooters are accustomed to relatively heavy handguns that offer more resistance to recoil after firing.

The processing method of this invention provided the combination of a high-caliber handgun with a very low carrying weight that is advantageous to law enforcement officers, hunters and backpackers.

The reported performance results for handguns that are produced under the principles of this invention are unprecedented for gun frames. It is significant to note that the durability and light weight of this alloy have precipitated the use of the principles of this invention for other gun components that were traditionally reserved for steel alloys. For example, the alloy performance also enabled its use as a cylinder in a .32 caliber revolver. As with the gun frames, the cylinder displayed the surprising combination of light weight (one-third that of steel) and the ability to survive repeated firing loads. The use of an aluminum-based alloy as a cylinder is another unprecedented achievement

DESCRIPTION OF PRIOR ART

In most instances, various types of steel are utilized in handgun construction. In recent years, gun manufacturers have utilized new materials for various components of the handgun, e.g. aluminum alloy 7075 for pistol frames and titanium alloys for cylinders, in an attempt to reduce the weight of the handgun. In the instance of the alloy 7075 gun frame, the use has been limited to relatively low caliber pistol and revolver frames. Specifically, aluminum alloy 7075 is limited for use as a frame material for .22 and 9 mm caliber rounds in pistols and for .22 and .32 caliber rounds in revolvers. Handgun users are seeking the desirable combination of a heavy caliber handgun with "stopping power" combined with light weight. Heretofore this performance feature has not been achieved.

When considering aluminum alloys for use in handguns, the gun designer considers various processing approaches and the accompanying mechanical properties to derive a manufacturing plan and a design. In the design process, the cross-sectional area of the handgun frame is sized in accordance with the mechanical properties. Cast aluminum alloys typically have yield strength values in the range of 35 to 45 ksi and elongation values of about 5%. The drawback to utilizing a cast aluminum alloy as a handgun frame in this strength regime is that 1) this strength level is not sufficient to enable the use of cast aluminum alloys in heavy caliber handguns and 2) the cross-section must be relatively thick compared to steel to withstand firing loads in small caliber handguns.

Wrought aluminum alloy 7075 has superior mechanical properties to cast aluminum alloys with a yield strength of about 65 ksi and elongation values of about 10%. The use of 7075 in low caliber pistol frames is prevalent. When alloy 7075 is utilized in heavy caliber revolvers, however, the frames typically fracture during test firing within a few rounds. Consequently, alloy 7075 cannot be used in heavy caliber revolvers. Moreover, the use of alloy 7075 in smaller caliber frames must be accompanying by thicker gages relative to titanium and steel frames.

It should be noted that while mechanical properties can be used as a guideline for designing handgun frames, the frames must withstand explosive, instantaneous loads when fired. Because these loads cannot be practically simulated, the approach to prove the concept is to manufacture an actual handgun frame that is subsequently subjected to multiple test firings.

It would be highly desirable to derive a method for producing a material that can be readily fabricated into a handgun frame with sufficient mechanical properties to withstand the high operating stresses inherent to high caliber gun frames. Moreover, the enhanced properties can be used in existing low caliber handguns; in this instance, the designers can simply reduce the cross sectional area of the frame to affect a weight savings relative to previous models.

BRIEF DESCRIPTION OF SEQUENCES

Because the starting stock of this invention is fabricated into gun frames and components that must withstand severe shock loading and substantial wear and tear, the processing parameters of the starting stock should be derived to produce desirable combinations of yield strength, elongation and hardness. The various steps to achieve these properties are as follows:

[t1]

[Forged Gun Frames and Components]

| | Processing Step | Purpose |
|---|---|---|
| 1) | Casting of Billet | Provide mixture of alloying elements |
| 2) | Homogenize Billet | Refine as-cast structure |
| 3) | Extrude into bar | Provide reasonable size for forging and further refine grain structure |
| 4) | Forge Into Gun Frame or Component | Provide near net shape semi-finished component |
| 5) | Solution Heat Treat | Place alloying elements into solid solution |
| 6) | Water Quench | Achieve metastable solid solution |
| 7) | Artificial Age | Promote precipitation strengthening |

[t3]

[Forged Gun Frames and Components]

| | Processing Step | Purpose |
|---|---|---|
| 1) | Casting of Billet | Provide mixture of alloying elements |
| 2) | Homogenize Billet | Refine as-cast structure |
| 3) | Forge Into Gun Frame or Component | Provide near net shape semi-finished component |
| 4) | Solution Heat Treat | Place alloying elements into solid solution |
| 5) | Water Quench | Achieve metastable solid solution |
| 6) | Artificial Age | Promote precipitation strengthening |

[t5]

[Machined Gun Frames and Components]

| | Processing Step | Purpose |
|---|---|---|
| 1) | Casting of Billet | Provide mixture of alloying elements |
| 2) | Homogenize Billet | Refine as-cast structure |
| 3) | Extrude into bar | Provide reasonable size for forging and further refine grain structure |
| 4) | Machine Into Gun Frame or Component | Provide near net shape semi-finished component |

-continued

[Machined Gun Frames and Components]

| | Processing Step | Purpose |
|---|---|---|
| 5) | Solution Heat Treat | Place alloying elements into solid solution |
| 6) | Water Quench | Achieve metastable solid solution |
| 7) | Artificial Age | Promote precipitation strengthening |

Note that for forged gun frames or components the final machining can be performed after steps 4 or 7, and for the machined gun frames and components, the final component can also be machined after step 7. While the preferred starting stock of this invention can be advantageously processed to achieve the desirable combination of lightweight and durability for gun frames and components, the initial alloy mixture can be derived from many alloying combinations, including: Al—Zn—Mg—Cu, Al—Zn—Mg, Al—Cu—Mg, Al—Cu—Li and Al—Si—Mg. Accordingly, the method taught in this invention can be adapted to many potential starting alloy combinations.

DETAILED DESCRIPTION

According to the present invention, a method for producing lightweight starting stock for use in handgun frames is provided. In a preferred embodiment of the invention, an alloy is selected that is comprised of primary elements Zn, Mg and Cu combined with grain refining elements Zr, Cr and Sc, with the balance consisting of aluminum. The elements are blended together in the appropriate ratios and direct chill cast into billets. After the billet is homogenized, it is used as stock for forging, or alternatively, the billet is heated to an elevated temperature and extruded into a final shape. The shape is suitable for subsequent forming operations such as forging or secondary machining operations. If the gun component is to be forged, the forging stock can be supplied in a number of tempers, for example the "as-fabricated" or "annealed" tempers. The forging stock can then be heated to an elevated temperature and forged in the appropriate forging die. Once the final shape is attained, the alloy is solution heat treated, quenched and subjected to artificial aging.

In the instance where the starting stock is to be machined into a final component, it is advantageous to apply the full heat treatment prior to the machining operation. Accordingly, the starting stock is solution heat treated, quenched and subjected to artificial aging.

DETAILED DESCRIPTION OF THE PREFERRED EMBODIMENTS

In accordance with this invention, stock used for subsequent forging or machining into gun components may be made from a 7XXX-series aluminum alloy. Preferably, this aluminum alloy consists essentially of about 6.5 to 8.5% Zn, 1.0 to 3.0% Mg, 1.0 to 2.5% Cu and lesser amounts of grain and structure refining elements including Zr, Ti, Cr, Mn and Sc. More preferably, this aluminum alloy includes essentially from about 7.4 to 9.0% Zn, 1.8 to 2.2% Mg and 1.6 to 1.8% Cu, and 0.02 to 0.50% of one or more grain and structure refining elements Zr, Ti, Cr, Mn, or Sc.

EXAMPLES

Example 1

Mechanical Properties of Starting Stock. The alloy formulation shown in Table 1 was direct chill cast into billets.

The billets were then homogenized, pre-heated to 650° F. and extruded into round bars with a 1.5-inch diameter. The 1.5-inch diameter bar was then subjected to the following heat treatment:

1) Solution heat treatment at 875° F. for 1 hour, 2) Water Quench, 3) Hold at Ambient Temperature for 72 Hours, 4a) Age at 250° F. for 8 hours followed by 320° F. for 8 hours, or 4b) Age at 250° F. for 24 hours.

TABLE 1

| Composition of Forging Stock (weight %) | | | | | | | |
|---|---|---|---|---|---|---|---|
| Zn | Mg | Cu | Zr | Ti | Cr | Sc | Al |
| 7.75 | 1.83 | 1.75 | 0.114 | 0.015 | 0.029 | 0.074 | balance |

As shown in Table 2, the mechanical properties of this alloy formulation indicate a substantial improvement over mainstay gun frame alloy 7075 for both heat treatment practices attempted. Surprisingly, the alloy also displays a corresponding improvement in elongation compared to alloy 7075.

[t4]

TABLE 2

| Mechanical Properties of Forging Stock (mean of 2) | | | |
|---|---|---|---|
| Heat Treatment | Yield Strength (ksi) | Ultimate Tensile Strength (ksi) | Elongation (%) |
| A | 92.3 | 94.5 | 113.8 |
| B | 99.5 | 105.0 | 13.0 |

Example 2

Forging Fabrication and Properties of Forging. The alloy composition from Example 9 was extruded into 1.5-inch diameter forging stock, annealed and forwarded to a gun manufacturer for forging. Although the strength of this formulation is much greater than that of alloy 7075, the manufacturer was able to readily forge this alloy into a gun frame. The forged gun frame was then subjected to the heat treatment specified in Example 1. In the forged component, yield strength values were >90 ksi. By comparison, alloy 7075 usually attains yield strength values of 60–70 ksi in forgings.

Example 3

Performance in Gun Frames and Cylinders. Although outstanding mechanical properties and manufacturing behavior has been proven, the final step is the determination of the suitability of a high-strength, lightweight starting stock for use in a handgun. Once the gun frames were manufactured via forging and machining, firing tests were conducted to compare the performance of the alloy with alloy 7075. It should be noted that alloy 7075 revolver frames are not able to withstand repeated firings with a .357 caliber proof load. Often, the 7075 frames break after just a few test firings, thereby excluding this material as a candidate for heavy caliber revolvers. In contrast, the gun frame comprised of the lightweight alloy stock of this invention withstood extensive test firings. Specifically, a .357 Magnum was mounted in a gun vise and subjected to 3000 rounds using an ultra-high caliber 158-grain .357 load. Even though this test is the equivalent of 9000 hand-fired rounds, the gun held up to this extensive number of firing cycles. Previously, only steel and titanium alloys have withstood such rigorous testing. It is significant that the starting stock alloy of this invention can withstand the repeated firing loads since the gun frame is just one-third the weight of steel handgun frames and 70% lighter that titanium alloy frames.

It will be appreciated that an improved method for producing a lightweight alloy starting stock for gun frames has been disclosed. The starting stock enables the gun manufacturer to produce unprecedented combinations of light weight and durability for gun frames and components. While specific embodiments of the invention have been disclosed, those skilled in the art will appreciate that various modifications and alterations to these details could be developed in light of the overall teachings of this disclosure. Accordingly, the particular arrangements disclosed are meant to be illustrative only and not limiting as to the scope of the invention which is to be given the full breadth of the appended claims and any equivalents thereof.

What is claimed is:

1. A method for producing a lightweight starting stock for gun frames and gun components comprising the following steps in sequence:

a) mixing alloying elements into aluminum with the alloy composition containing 6.2 to 9.0 wt % Zn, 1.0 to 3.0 wt % Mg, 0 to 2.5 wt % Cu and 0.02 to 0.50 wt % of at least one grain refining element selected from the group consisting of Zr, Sc, Cr, Mn, Ti and Hf and casting said elements to provide a billet, b) extruding said billet to provide starting stock, c) forging said starting stock to provide a gun frame or gun component, d) solution heat treating said gun frame or gun component to provide a solution heat treated gun frame or gun component, e) quenching said gun frame or gun component to provide a quenched gun frame or gun component f) artificial aging said gun frame or gun component to provide and artificially aged gun frame or gun component wherein said gun frame or gun component has a yield strength value of at least 80 ksi.

2. The method of claim 1 wherein said gun frame or gun component has a yield strength value of at least 90 ksi.

3. The method of claim 1 wherein secondary machining is performed on the forged gun frame or gun component.

4. The method of claim 1 wherein the billet is homogenized prior to extrusion.

5. A method for producing a lightweight starting stock for gun frames and gun components comprising the following steps in sequence:

a. mixing alloying elements into aluminum with the alloy composition containing 6.2 to 9.0 wt % Zn, 1.0 to 3.0 wt % Mg, 0 to 2.5 wt % Cu and 0.02 to 0.50 wt % of at least one grain refining element selected from the group consisting of Zr, Sc, Cr, Mu, Ti and Hf and casting said elements to provide a billet, b. forging said billet to provide a gun frame or gun component, e. solution heat treating said gun frame or gun component to provide a solution heat treated gun frame or gun component, d. quenching said gun frame or gun component to provide a quenched gun frame or gun component e. artificial aging said gun frame or gun component to provide and artificially aged gun frame or gun component wherein said gun frame or gun component has a yield strength value of at least 80 ksi.

6. The method of claim 5 wherein said gun frame or gun component has a yield strength value of at least 90 ksi.

7. The method of claim 5 wherein secondary machining is performed on the forged gun frame or gun component.

8. The method of claim 5 wherein the billet is homogenized prior to forging.

9. A method for producing a lightweight starting stock for gun frames and gun components comprising the following steps in sequence:

a. mixing alloying elements into aluminum with the alloy composition containing 6.2 to 9.0 wt % Zn, 1.0 to 3.0 wt % Mg, 0 to 2.5 wt % Cu and 0.02 to 0.50 wt % of at least one grain refining element selected from the group consisting of Zr, Sc, Cr, Mn, Ti and Hf and casting said elements to provide a billet, b. extruding said billet to provide starting stock, c. machining said starting stock to provide a gun frame or gun component, d. solution heat treating said gun frame or gun component to provide a solution heat treated gun frame or gun component, e. quenching said gun frame or gun component to provide a quenched gun frame or gun component f. artificial aging said gun frame or gun component to provide and artificially aged gun frame or gun component wherein said gun frame or gun component has a yield strength value of at least 80 ksi.

10. The method of claim 9 wherein said gun frame or gun component has a yield strength value of at least 90 ksi.

11. The method of claim 9 wherein secondary machining is performed on the machined gun frame or gun component.

12. The method of claim 9 wherein extruded starting stock is subjected to solution heat treatment, quenching, artificially aging and then subsequently machined.

13. The method of claim 9 wherein the billet is homogenized prior to extrusion.

* * * * *